United States Patent [19]

Brock et al.

[11] Patent Number: 5,041,229

[45] Date of Patent: Aug. 20, 1991

[54] AEROSOL JET ETCHING

[75] Inventors: James R. Brock; Isaac Trachtenberg, both of Austin, Tex.

[73] Assignee: Board of Regents, the University of Texas System, Austin, Tex.

[21] Appl. No.: 615,421

[22] Filed: Nov. 15, 1990

Related U.S. Application Data

[62] Division of Ser. No. 289,642, Dec. 21, 1988, Pat. No. 4,973,379.

[51] Int. Cl.[5] ..... H01L 21/00

[52] U.S. Cl. ..... 252/79.1; 156/640

[58] Field of Search ..... 252/79.1; 156/640

[56] References Cited

U.S. PATENT DOCUMENTS

| | | | |
|---|---|---|---|
| 3,616,049 | 10/1971 | Moore | 156/640 |
| 3,935,041 | 1/1976 | Goffredo et al. | 156/640 |
| 4,383,645 | 11/1990 | Figiel et al. | 239/13 |
| 4,609,575 | 9/1986 | Burkman | 156/640 |

FOREIGN PATENT DOCUMENTS

| | | |
|---|---|---|
| 0725590 | 1/1966 | Canada . |
| 3331816 | 3/1985 | Fed. Rep. of Germany . |

OTHER PUBLICATIONS

IBM Technical Disclosure Bulletin: "Circuit Etching Process", by Butora et al., ©2/1970, vol. 12, No. 9.

Appl. Phys. Lett.: "Aerosol Jet Etching of Fine Patterns", by Cher et al., ©12-28-87, 51(26).

*Primary Examiner*—Richard Bueker
*Assistant Examiner*—George A. Goudreau
*Attorney, Agent, or Firm*—Arnold, White & Durkee

[57] ABSTRACT

A device and method for etching a body are provided capable of etching fine geometry patterns utilizing the high selectivity of wet etching and the anisotropic etch characteristics of dry etching. The body to be etched is placed in a reduced pressure etching chamber. An inert carrier gas is bubbled through heated liquid etchant producing a vapor stream of liquid etchant. A non-reactive gas is chilled producing a cold gas stream. The vapor stream and the cold gas stream are combined in an aerosol generation nozzle producing a high concentration of fine aerosol particles by homogeneous nucleation. The fine aerosol particles enter an aerosol growth chamber and form larger particles through thermal coagulation. The larger particles are accelerated out of the growth chamber through an expansion nozzle positioned within the reduced pressure etching chamber and directed toward the body to be etched. This aerosol jet of etchant impacts the surface of the body to be etched. The small size of these larger particles allows for etching fine geometry patterns. Additionally, aerosol jet etching avoids the need to rinse the body after being etched as required in wet etching to halt the etching process.

11 Claims, 3 Drawing Sheets

AEROSOL JET ETCHING

This is a division of copending application Ser. No. 289,642, filed Dec. 21, 1988, now U.S. Pat. No. 4,973,3[illegible], issued Nov. 27, 1990.

BACKGROUND OF THE INVENTION

1. Field of the Invention

This invention relates to a device and a method for etching a body comprising material such as silicon or gallium arsenide. In particular, the invention relates to the volatilization and recondensation of a liquid etchant that is then sprayed in the form of an aerosol jet on the body to be etched.

2. Description of Related Art

Two commonly used methods of etching are wet etching and dry etching. In wet etching, those portions of the body not to be etched are covered with a protective layer of material. Etchant is chosen to chemically react with and etch the unprotected portions of the body while not reacting with the protective layer of material. In conventional wet etching, the body is then immersed in the liquid etchant. Conventional wet etching has the advantage of high selectivity because of the chemical etch mechanism involved. However, because of its isotropic etching characteristics, wet etching has limitations for etching fine geometry patterns. In particular, where deep etching occurs adjacent to a protected surface, etching may occur below the protective layer. Wet etching also uses a significant quantity of chemicals in the etching process. Additionally, etched particles floating free in the liquid etchant may redeposit on the body and thus cause contamination.

Spray etching is a type of wet etching. Spray etching merely sprays very large particles of liquid etchant on the body to be etched. Spray etching displays several of the characteristics of wet etching including the isotropic nature of the etch and the wet etch limitations for etching fine geometry patterns. In spray etching, the quantity of liquid etchant used and the likelihood of contamination through redeposition are reduced as compared to conventional wet etching. Further, in wet etching the body to be etched must be rinsed of etchant promptly after etching. Neither spray etching nor conventional wet etching can etch deep, narrow channels because surface tension prevents etchant from entering and etching such channels.

Dry etching, sometimes called plasma-assisted etching, has the advantage of high etch anisotropy and thus dry etching methods are particularly suitable for fine geometry patterns. However, the selectivity of dry etching is not sufficient to prevent etching of layers or substrates under an etched film. Also, surface radiation damage from dry etching causes problems in device fabrication.

SUMMARY OF THE INVENTION

The method of the present invention for etching a body largely solves the problems associated With known etching methods by combining the high selectivity of wet etching with the anisotropic etch characteristics of dry etching. Because the method hereof uses an aerosol jet of etchant to etch, the redeposition problem associated with conventional wet etching is avoided and relatively low quantities of chemicals are required. Additionally, the small particle size utilized in aerosol jet etching allows the etching of fine geometry patterns.

Therefore, the method of the present invention is particularly effective for etching fine geometries in very large scale integrated circuits.

Broadly speaking, the method of etching of the present invention includes placing the body to be etched in a holder in a reduced pressure etching chamber, volatilizing a liquid etchant into a controlled, vapor stream of etchant, combining this vapor stream with a cold stream of non-reactive gas in an aerosol generation nozzle producing a high concentration of fine aerosol particles, growing these fine aerosol particles in an aerosol growth chamber to form larger particles which are accelerated out of the aerosol growth chamber through an expansion nozzle and directing these larger particles into the etching chamber toward the holder containing the body to be etched. This is the aerosol jet. Etching occurs where the particles from the aerosol jet impact, i.e., adhere to and wet, the surface of the body to be etched. Wetting of the surface is necessary for etching to occur. The larger particles impacting the body to be etched are typically of a diameter in the range of 0.05 to 0.2 microns. These larger particles are still small enough to etch deep, narrow channels in the body as required by fine geometry patterns. Because the aerosol jet releases small particles, both chemical exhaustion of etchant on the body and evaporation halt the etching process eliminating the need to rinse the body after etching to stop the etching process as required in wet etching. The etching process is controllable primarily through the total flow rate of the cold gas stream and the vapor stream, the pressure in the etching chamber and the temperature of the holder and body to be etched.

The device of the present invention for etching a body broadly includes a reduced pressure etching chamber for housing the body to be etched, a holder for securing the body to be etched, a carrier gas bubbled through a liquid etchant at a temperature generating a vapor stream of etchant, a nozzle for combining the vapor stream with a cold stream of non-reactive gas producing a high concentration of fine aerosol particles, a chamber for growing the fine aerosol particles to form larger particles and an expansion nozzle for outletting the larger particles into the etching chamber. The expansion nozzle is directed toward the holder containing the body to be etched. The vapor stream is maintained at a temperature sufficient to retard the formation of condensation prior to the stream's entering the aerosol generation nozzle The cold stream is chilled prior to entering the aerosol generation nozzle. Controlling the total flow rate of the cold gas stream and the vapor stream, the pressure in the etching chamber and the temperature of the holder and the body to be etched, primarily controls the etching rate.

The present invention offers significant control over the etching process while combining the high selectivity of wet etching with the fine line pattern delineation of dry etching.

DETAILED DESCRIPTION OF THE PREFERRED EMBODIMENT

Figure 1:
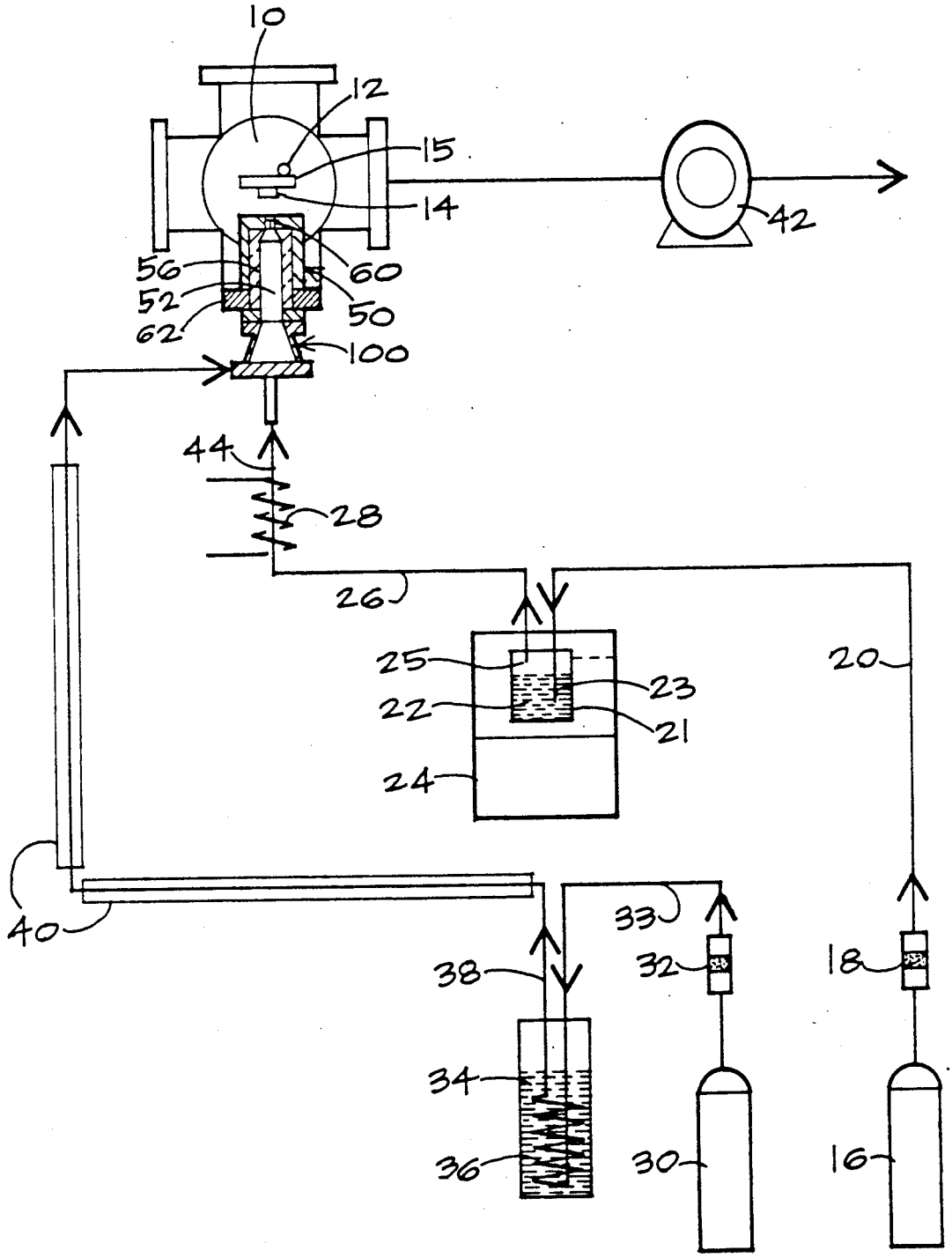
FIG. 1 is a schematic diagram of a device in accordance with the present invention.
Figure 2:
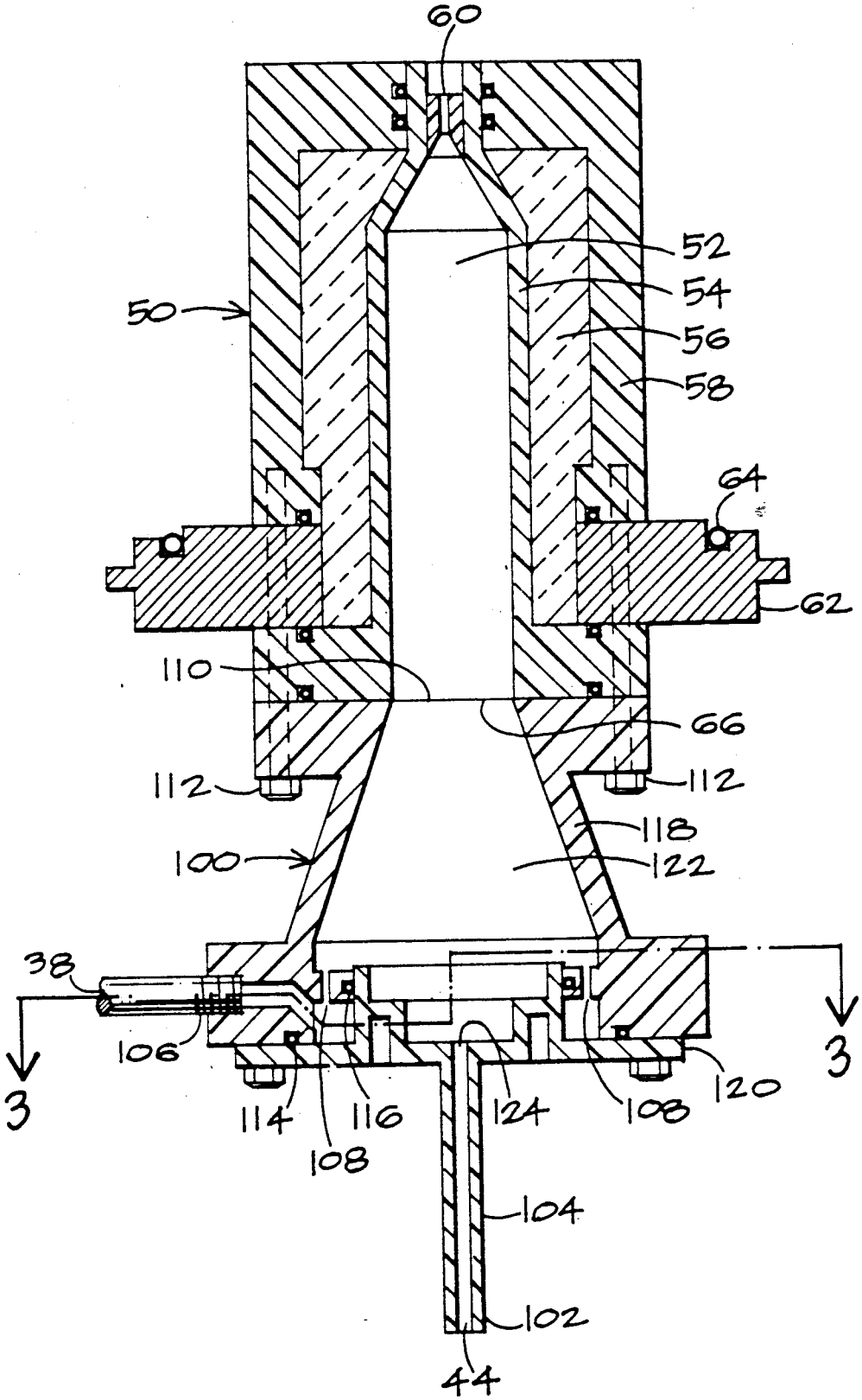
FIG. 2 is a cross-section of an aerosol generation nozzle abutting an aerosol growth chamber in accordance with the present invention.

FIGS. 1–4 illustrate a preferred embodiment of a device for aerosol jet etching in accordance with the present invention. As shown in FIGS. 1 and 2, non-reactive gas 16 is filtered through gas filter 18, producing particle-free non-reactive carrier gas stream 20. Closable etchant container 21 contains liquid etchant 22. Carrier gas 20 enters liquid etchant 22 through a series of small holes in the submerged portion of tube 23 carrying carrier gas 20 into closed etchant container 21. In the preferred embodiment, the submerged portion of tube 23 contains about 15 holes with diameter of about 0.6 millimeters each. One skilled in the art will recognize that a variety of configurations may be used to route carrier gas stream 20 into liquid etchant 22. Liquid etchant 22 is heated. In the preferred embodiment etchant container 21 is immersed in constant temperature circulator 24 to control the temperature of liquid etchant 22. In the preferred embodiment a temperature of approximately 50° C. is used. One skilled in the art will recognize that this temperature may be varied and that a heat source other than a constant temperature circulator may be used.

Hot vapor stream of etchant 26 is outletted from etchant container 21 through open end 25 of the tube carrying hot vapor stream 26 positioned Within etchant container 21 and not submerged in liquid etchant 22. Heat source 28 maintains the temperature of vapor stream 26 at temperature sufficient to retard the formation of condensate in the tubing carrying hot vapor stream of etchant 26 and warm vapor stream 44. Warm vapor stream 44 enters aerosol generation nozzle 100 at vapor stream of etchant inlet 102.

In the preferred embodiment, heat source 28 comprises heating tape wrapped about the tubing carrying vapor streams 26 and 44. One skilled in the art will recognize that a variety of alternate heat sources or insulations may be used in place of the exemplified heat source 28.

Non-reactive gas 30 is filtered through gas filter 32, creating particle-free non-reactive gas stream 33. Gas stream 33 enters coil 36 which is submerged in cryogenic liquid 34 producing non-reactive cold gas stream 38 which passes through tubing protected by insulation 40. Cold gas stream 38 enters aerosol generation nozzle 100 at cold gas stream inlet 106.

Use of the terms "non-reactive" and "inert" throughout this application refer to materials, compositions or chemicals that do not chemically react with the other materials, compositions or chemicals that the non-reactive or inert materials, compositions or chemicals may encounter in the device or method of the present invention.

Use of the terms "etchant" and "liquid etchant" throughout this application refer to chemicals or chemical compositions that when volatilized and recondensed either remain or produce chemicals or chemical compositions capable of chemically reacting with and etching the body to be etched. In the preferred embodiment, an azeotrope of hydrofluoric acid is used as etchant 22 where body to be etched 14 is silicon dioxide. In the preferred embodiment, a mixture of bromine-methanol or an azeotrope of hydrochloric acid is used as etchant 22 where the body to be etched 14 is gallium arsenide.

In the preferred embodiment, nitrogen is used as non-reactive gases 16 and 30 and liquid nitrogen is used as cryogenic liquid 34. However, cold gas stream 38 may be at a temperature of up to 40° C. in the method of the present invention. Further, non-reactive gases 16 and 30 may be one or more or a mixture of nitrogen, helium and argon. It can be appreciated by one skilled in the art that non-reactive gases 16 and 30 may comprise different non-reactive gases.

Figure 3:
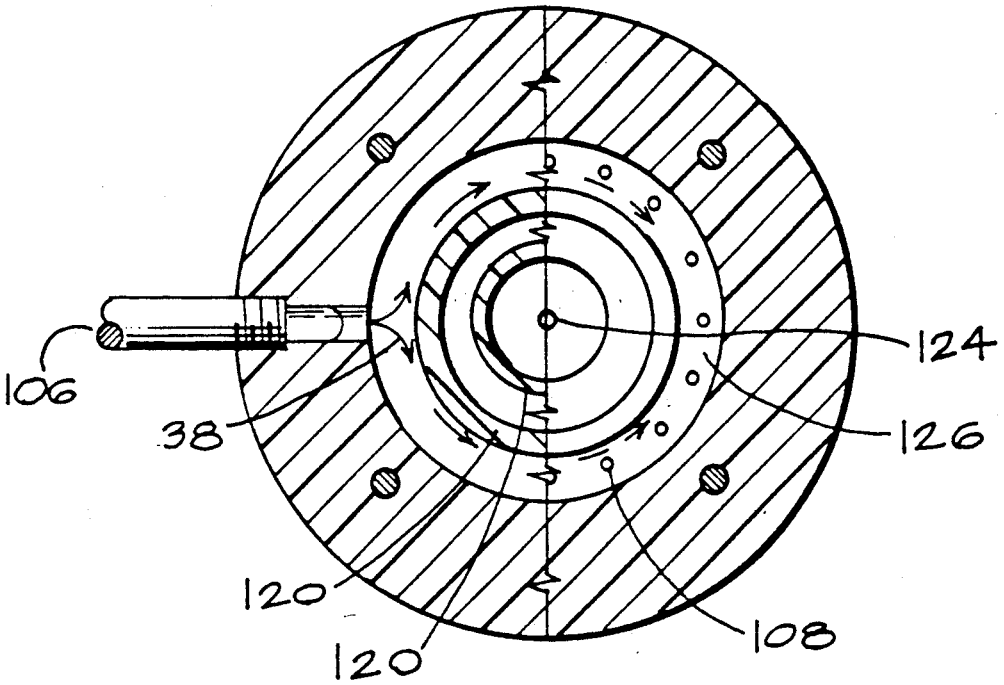
FIG. 3 is a sectional view along line 3—3 at FIG. 2.

Vapor stream 44 enters aerosol generation nozzle 100 through vapor stream of etchant inlet 102 of inlet tube 104. Inlet tube 104 outlets into aerosol generation nozzle mixing chamber 122 through vapor stream of etchant outlet 124. As shown in FIG. 3, cold gas stream 38 passes through cold gas stream inlet 106 and enters staging chamber 126 prior to passing through cold gas stream outlets 108. As shown in FIGS. 1 and 2, cold gas stream 38 then enters mixing chamber 122 through cold gas stream outlets 108. Inlet tube 104, vapor stream inlet 102, vapor stream outlet 124, cold gas stream inlet 106 and cold gas stream outlets 108 are all part of aerosol generation nozzle cover 120. O-ring seals 114 and 116 serve to inhibit leakage between aerosol generation nozzle cover 120 and main body of aerosol generation nozzle 118. Aerosol generation nozzle outlet 110 is positioned opposite vapor stream outlet 124.

As shown in FIG. 3, in the preferred embodiment, vapor stream outlet 124 is positioned centrally to sixteen cold gas stream outlets 108. Vapor stream outlet 124 is a single outlet with a diameter of approximately 2.0 millimeters and the sixteen inert gas stream outlets 108 each have a diameter of approximately 0.5 millimeters. Cold gas stream outlets 108 are evenly spaced and positioned radially about vapor stream outlet 124. Each cold stream outlet 108 is positioned approximately 2.3 centimeters from vapor stream outlet 124. One skilled in the art will recognize that a variety of sizes of cold gas stream outlets 108 and vapor stream outlet 124 can be utilized As shown in FIGS. 1 and 2, aerosol generation nozzle 100 is designed to retard the formation of vapor condensate on aerosol generation cover 120 and on the interior walls of mixing chamber 122. In the preferred embodiment, aerosol generation nozzle cover 120 is made of teflon to retard heat transfer between vapor stream 44 and cold gas stream 38. Main body 118 is made of polyethylene in the preferred embodiment. The cold gas stream-vapor stream flow pattern within mixing chamber 122 creates a high concentration of fine aerosol particles by homogeneous nucleation. Homogeneous nucleation creates fine aerosol particles in a very high concentration. These fine aerosol particles are of a size in the range of 0.001 to 0.02 microns in diameter. These fine aerosol particles need to grow larger to insure that they have sufficient inertia to impact upon body to be etched 14. Particle growth occurs in growth chamber interior 52 of aerosol growth chamber 50. The grown, larger particles of etchant are in the range of 0.05 to 0.2 microns in diameter.

Growth chamber 50 is attached to aerosol generation nozzle 100 by attaching means such as screws 112. Aerosol generation nozzle 100 is positioned relative to growth chamber 50 to align aerosol growth chamber inlet 66 with aerosol generation nozzle outlet 110. Growth chamber 50 is cylindrical in shape and is connected to expansion nozzle 60.

Thermal coagulation of the aerosol particles occurs in growth chamber interior 52. Thermal coagulation of an aerosol is a process wherein aerosol particles collide with one another due to relative motion, e.g., Brownian motion, between them, adhere and grow to form larger particles. This results in a decrease in the number concentration of particles and an increase in particle size. In the preferred embodiment, growth chamber insulation 56 comprises fiberglass although any effective form of insulation will suffice. Growth chamber insulation 56 retards heat transfer between etching chamber 10 and growth chamber interior 52 and retards particle evaporation in growth chamber interior 52. Flange 62 secures aerosol growth chamber 50 to etching chamber 10. O-ring seal 64 is seated in flange 62. O-ring seal 64 assists in sealing growth chamber 50 to etching chamber 10. Growth chamber sidewalls 54 of growth chamber 50 are insulated by growth chamber insulation 56 which is covered by growth chamber exterior walls 58.

Expansion nozzle 60 is positioned within etching chamber 10 and is directed towards holder 15 and body to be etched 14. Vacuum pump 42 allows etching chamber 10 to be maintained at a reduced pressure. This reduced pressure causes the larger particles in growth chamber interior 52 to accelerate through expansion nozzle 60. This acceleration of the larger particles through expansion nozzle 60 is the aerosol jet. Particles reach a velocity in the range of 150 to 350 meters per second in the aerosol jet.

In the preferred embodiment, pressure within etching chamber 10 is typically in the range of 0.1 to 400 torr. At greater pressures, gas in etching chamber 10 may interfere with the aerosol jet.

Heater 12 allows control of the temperature of holder 15 and body to be etched 14 and thus assists in controlling the etching rate.

In the preferred embodiment, holder 15 and body to be etched 14 are positionable relative to expansion nozzle 60. This allows etching of bodies with a surface area exceeding the surface area impacted by the aerosol jet. One skilled in the art will recognize that expansion nozzle 60 or holder 15 and body to be etched 14 or all may be moveable so as to position expansion nozzle 60 relative to holder 15 and body to be etched 14. In the preferred embodiment, expansion nozzle 60 is positioned inside etching chamber 10 and 2 to 5 centimeters from body to be etched 14. Expansion nozzle 60 is made of teflon in the preferred embodiment.

Figure 4:
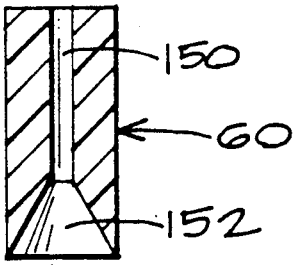
FIG. 4 is a cross-section of an expansion nozzle in accordance with the present invention; and, FIG. 4A is a cross-section of another embodiment of an expansion nozzle in accordance With the present invention.

Expansion nozzle 60 directs the aerosol jet from growth chamber 50 toward holder 15 and body to be etched 14. FIG. 4 shows an embodiment of expansion nozzle 60. In FIG. 4, funnel-shaped inlet 152 is positioned near growth chamber interior 52 and tubular passageway 150 is positioned away from funnel-shaped inlet 152. Tubular passageway 150 is approximately 0.2 to 1.2 millimeters in diameter.

Figure 4A:
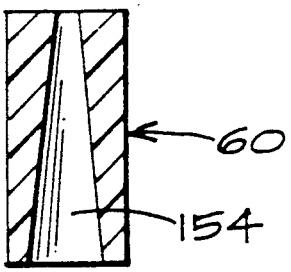

An alternate embodiment of expansion nozzle 60 is shown in FIG. 4A. In FIG. 4A, expansion nozzle 60 embodies frusto-conical passageway 154, the smaller diameter portion of the cone being positioned away from growth chamber interior 52. In the preferred embodiment, the smaller diameter of the cone of passageway 154 is approximately 0.2 to 1.2 millimeters in diameter.

As shown in FIGS. 1 and 2, in the preferred method of etching a body, particle free non-reactive carrier gas stream 20 is produced by passing non-reactive gas 16 through gas filter 18. Carrier gas 20 is bubbled through liquid etchant 22 contained in closable etchant container 21. In the preferred embodiment, non-reactive gas 16 is nitrogen. Carrier gas stream 20 is bubbled through liquid etchant 22 through a plurality of small holes in the submerged portion of tube 23 carrying carrier gas stream 20 into closed etchant container 21. Liquid etchant 22 and etchant container 21 are immersed in a constant temperature circulator to control the temperature of liquid etchant 22. In the preferred embodiment the temperature of liquid etchant 22 is 50° C. One skilled in the art Will recognize that a range of temperatures may be used and that heat sources other than a constant temperature circulator may be used.

Hot vapor stream of etchant 26 is generated within etchant container 21 and exits etchant container 21 through open end 25 of the tube carrying hot vapor stream 26 positioned within etchant container 21 and not submerged in liquid etchant 22. Hot vapor stream 26 cools forming Warm Vapor stream of etchant 44. Heat source 28 maintains vapor streams 26 and 44 at a temperature sufficient to retard the formation of condensate on the walls of the tubing of vapor streams 26 and 44. In the preferred embodiment, heat source 28 comprises heating tape wrapped about the tubing carrying hot vapor streams 26 and 44.

It can be appreciated by one skilled in the art that non-reactive gas 16 and non-reactive gas 30 may comprise different non-reactive gases. It can be further appreciated by one skilled in the art that heat source 28 may be omitted in an alternate embodiment wherein vapor streams 26 and 44 do not tend to condense prior to entering aerosol generation nozzle 100. It can also be appreciated by one skilled in the art that a variety of alternate heat sources or insulations may be used in place of the exemplified heat source 28.

Vapor stream 44 enters aerosol generation nozzle 100 at vapor stream of etchant inlet 102.

Cold stream of non-reactive gas 38 is formed by passing non-reactive gas 30 through gas filter 32 producing particle free non-reactive gas stream 33. Particle free non-reactive gas stream 33 passes through coil 36 submerged in cryogenic liquid 34 producing cold gas stream 38. In the preferred embodiment, non-reactive gases 16 and 30 are nitrogen and cryogenic liquid 34 is liquid nitrogen. However, cold gas stream 38 may be at a temperature of up to 40° C. in the method of the present invention. Further non-reactive gases 16 and 30 may be one or more or a mixture of nitrogen, helium and argon.

Cold gas stream 38 enters aerosol generation nozzle 100 through cold gas stream inlet 106.

In the preferred embodiment, an azeotrope of hydrofluoric acid is used as etchant 22 where body to be etched 14 is silicon dioxide. In the preferred embodiment, a mixture of bromine-methanol or an azeotrope of hydrochloric acid is used as etchant 22 where the body to be etched 14 is gallium arsenide.

Vapor stream 44 mixes With cold gas stream 38 in aerosol generation nozzle mixing chamber 122 of aerosol generation nozzle 100. Vapor stream inlet 102 is inlet to inlet tube 104. Inlet tube 104 outlets vapor stream 44 into aerosol generation nozzle mixing chamber 122 through vapor stream of etchant outlet 124. Cold gas stream 38 enters aerosol generation nozzle 100 through cold gas stream inlet 106.

As shown in FIG. 3, cold gas stream inlet 106 allows cold gas stream 38 to enter staging chamber 126. Cold gas stream 38 enters staging chamber 126 and then enters mixing chamber 122 by passing through cold gas stream outlets 108. In the method of the preferred embodiment, cold gas outlets 108 are positioned radially about vapor stream outlet 124.

As shown in FIGS. 1 and 2, in the method of the present invention, aerosol generation nozzle 100 generates a high concentration of fine aerosol particles by homogeneous nucleation and retards the formation of vapor condensate on the interior walls of mixing chamber 122 and on aerosol generation nozzle cover 120. The concentration of fine aerosol particles to non-reactive gas is typically in the range of 0.1 to 1 weight percent.

In the preferred embodiment, main body of aerosol generation nozzle 118 is constructed of polyethylene and aerosol generation nozzle cover 120 is made of teflon to retard heat transfer between vapor stream 44 and cold gas stream 38 prior to vapor stream 44 and cold gas stream 38 contacting each other in mixing chamber 122. O-ring seal 116 and O-ring seal 114 seal aerosol generation nozzle cover 120 to main body 118. Aerosol generation nozzle outlet 110 mates with aerosol growth chamber inlet 66.

In the method of the present invention, pressure and temperature of vapor stream 44, pressure and temperature of cold gas stream 38 and ratio of vapor stream 44 to cold gas stream 38 in mixing chamber 122 are controllable. These in turn control particle size and concentration in both aerosol generation nozzle 100 and aerosol growth chamber 50.

The high concentration of fine aerosol particles generated in mixing chamber 122 leave mixing chamber 122 through aerosol generation nozzle outlet 110 and enter growth chamber interior 52 through growth chamber inlet 66. Aerosol generation nozzle 100 is positioned relative to growth chamber 50 to align aerosol growth chamber inlet 66 with aerosol generation nozzle outlet 110. Growth chamber 50 is cylindrical in shape and is connected to expansion nozzle 60. Flange 62 allows aerosol growth chamber 50 to be positioned partially within etching chamber 10. O-ring seal 64 is seated in flange 62. O-ring seal 64 assists in sealing growth chamber 50 to etching chamber 10.

Growth chamber interior 52 is defined by growth chamber sidewalls 54. Growth chamber interior 52 is insulated to retard heat transfer from etching chamber 10 to growth chamber interior 52 preventing evaporation of aerosol particles from growth chamber interior 52.

In the method of the present invention, the aerosol particles generated in mixing chamber 122 are of a size in the range of 0.001 to 0.02 microns in diameter. These aerosol particles are grown to a larger size in the range of 0.05 to 0.2 microns in diameter to insure that they have sufficient inertia to strike body to be etched 14. Aerosol growth chamber 50 allows for this growth. Through thermal coagulation occurring in growth chamber interior 52, the fine aerosol particles generated by homogeneous nucleation collide With one another due to their relative motion, e.g., Brownian motion, between them, adhere and grow to form larger particles. This results in a decrease in the number concentration of particles and an increase in particle size within growth chamber interior 52. After thermal coagulation, the larger particles are accelerated through expansion nozzle 60. This is the aerosol jet. In the aerosol jet, the concentration of larger particles to non-reactive gas is typically in the range of 0.1 to 1 weight percent.

Etching chamber 10 is maintained at a reduced pressure by vacuum pump 42. This reduced pressure in etching chamber 10 allows the larger particles to accelerate through expansion nozzle 60 into etching chamber 10. In the preferred embodiment, this pressure is in the range of 0.1 to 400 torr. Gas molecules in the etching chamber are less massive than the particles from the aerosol jet. Hence, particles from the aerosol jet are largely unaffected by collisions with the gas molecules in the etching chamber at distances up to approximately 5 centimeters. At pressures above 400 torr in the preferred embodiment, gas in etching chamber 10 interferes with the aerosol jet.

Expansion nozzle 60 is directed toward holder 15 and body to be etched 14 within etching chamber 10. Body to be etched 14 and holder 15 are positionable relative to expansion nozzle 60. This allows etching a body with surface area greater than the area impacted by the aerosol jet. Passing through expansion nozzle 60, the aerosol particles are accelerated to a velocity in the range of 150 to 350 meters per second. This speed enhances particle impaction on body to be etched 14. In the preferred embodiment, expansion nozzle 60 is positioned between 2 and 5 centimeters from body to be etched 14. Heater 12 allows control of the temperature of holder 15 and body to be etched 14 and thus assists in controlling the etching process. Pressure in etching chamber 10 also controls the etching process by interfering with the ability of the aerosol jet to impact body to be etched 14, by partially controlling the acceleration of particles through expansion nozzle 60 into reduced pressure etching chamber 10 and by partially controlling the evaporation rate of particles in the aerosol jet.

Unlike conventional wet etching where the surface of the body to be etched is thoroughly wetted with etchant and etching occurs isotropically, the method of the present invention applies only the aerosol jet of etchant particles to the surface of the body to be etched. This allows some directionality in the application of the aerosol jet of etchant leading to higher degrees of anisotropy in the resulting etch.

For etching to occur, it is necessary that the particles from the aerosol jet impact, i.e., adhere to and wet, the body to be etched 14. Therefore it is necessary that an impinging particle from the aerosol jet not reflect from body to be etched 14. Additionally, the surface temperature of body to be etched 14 must be controlled and kept below the temperature at which evolution of vapor from an aerosol jet particle is sufficiently rapid that a vapor barrier is created between the particle and the surface of body to be etched 14 preventing the particle from wetting the surface.

The fraction of the surface occupied by aerosol jet particles at any instant is in the range of 0.01 to 1.0 (i.e. 1% to 100%). If aerosol jet particles remain resident on the surface of body to be etched 14 for extended periods, liquid films form leading to a loss of anisotropic etch characteristics. Anisotropic etch characteristics appear when the fraction of the surface covered by aerosol jet particles is below 1.0. The nearer the fraction of the surface covered is to 1.0, the faster the rate of etching. Therefore, etching chamber pressure, surface temperature of a body to be etched and particle size assist in controlling the etching process in the method of the present invention.

Unlike conventional wet etching or spray etching, increased temperature of the body to be etched may serve to reduce the etching rate. In conventional wet etching or spray etching the increased temperature increases the speed of the chemical reaction and this increases the etching rate. In the method of the present invention, an increased temperature of the body to be etched may cause evaporation of the particles of etchant and thus reduce the residence time of the particles of etchant on the surface of the body to be etched. Although the increased temperature does increase the speed of the chemical reaction between the particles and the body to be etched, the reduced residence time may result in a reduced etching rate.

The method of etching of the present invention combines the high selectivity of conventional wet etching with the desirable anisotropic etching characteristics and low quantity of chemical usage associated with dry etching. Because the method of the present invention uses an aerosol jet of etchant to etch, the redeposition problem associated with conventional wet etching is also avoided. The small particle size grown in the aerosol growth chamber allows etching of fine geometry patterns. Additionally, evaporation of the particles impacting the body to be etched avoids the need to rinse the body after etching as required in wet etching to halt the etching process.

What is claimed is:

1. A composition of matter comprising particles of liquid etchant in an inert, gaseous carrier, said particles having a diameter in the range of 0.001 to 0.2 microns and said particles being suspended in said inert, gaseous carrier.

2. The composition of matter of claim 1 wherein said liquid etchant is an azeotrope.

3. The composition of matter of claim 1 wherein the concentration of said particles in said inert gaseous medium is typically in the range of 0.1 to 1 weight percent.

4. A composition of matter comprising particles of liquid etchant suspended in an inert, gaseous medium, said particles having a diameter typically in the range of 0.05 to 0.2 microns.

5. The composition of matter of claim 4 wherein said particles consist of an azeotrope of liquid etchant.

6. The composition of matter of claim 4 wherein the concentration of said particles in said inert gaseous medium is typically in the range of 0.1 to 1 weight percent.

7. The composition of matter of claim 1 wherein the liquid etchant is hydrofluoric acid bromine-methanol or hydrochloric acid.

8. The composition of matter of claim 1 wherein the inert, gaseous carrier is one or more of nitrogen, helium and argon.

9. The composition of matter of claim 1 wherein the liquid etchant comprises hydrofluoric acid.

10. The composition of matter of claim 1 wherein the liquid etchant comprises bromine-methanol.

11. The composition of matter of claim 1 wherein the liquid etchant comprises hydrochloric acid.

* * * * *

UNITED STATES PATENT AND TRADEMARK OFFICE

CERTIFICATE OF CORRECTION

PATENT NO. : 5,041,229

DATED : August 20, 1991

INVENTOR(S) : James R. Brock et al

It is certified that error appears in the above-identified patent and that said Letters Patent is hereby corrected as shown below:

In claim 7, column 10, line 20, immediately after the word "acid" insert the punctuation mark --,--.

Signed and Sealed this

Fifteenth Day of December, 1992

*Attest:*

DOUGLAS B. COMER

*Attesting Officer*

*Acting Commissioner of Patents and Trademarks*